United States Patent [19]

Remus

[11] 3,976,965

[45] Aug. 24, 1976

[54] PAIRED COILED CONDUCTORS COMPACT-LONG LIFE

[75] Inventor: Casimer Frank Remus, Tunkhannock, Pa.

[73] Assignee: The Bendix Corporation, Teterboro, N.J.

[22] Filed: Oct. 28, 1975

[21] Appl. No.: 626,609

[52] U.S. Cl. ..... 336/120; 310/71

[51] Int. Cl.[2] ..... H01F 21/06

[58] Field of Search ..... 336/120, 119, 135; 310/68 R, 71

[56] References Cited

UNITED STATES PATENTS 3,611,230 10/1971 Maake ..... 336/120

3,924,174 12/1975 Fahrner ..... 336/120 X

*Primary Examiner*—Thomas J. Kozma

*Attorney, Agent, or Firm*—Anthony F. Cuoco; S. H. Hartz

[57] ABSTRACT

A synchro having a rotor with windings supported by a shaft for rotation through an angle of approximately 360° relative to a stator in which the rotor windings are connected to external circuitry by leads each of which is formed into a coil with a straight portion extending therefrom. The leads are disposed oppositely in a hollow portion of the shaft with the coil of each of one lead encircling the straight portion of the other lead and with the straight portions of the leads extending axially of the shaft.

7 Claims, 2 Drawing Figures

PAIRED COILED CONDUCTORS COMPACT-LONG LIFE

This invention relates to electrical devices having a rotor with windings which rotates relative to a stator.

Prior Art

Rotary transformers known in the art as synchros have one or more rotor windings which must be connected to external circuitry. Slip rings are commonly used for providing connections to the rotor windings. However, when the relative rotation of the rotor and stator is less than 360° the slip rings may be eliminated by forming the rotor leads into coils around a pin secured in a centrally located recess in a hollow portion of the rotor shaft. A structure of this kind is shown in U.S. Pat. No. 3,295,083 issued Dec. 27, 1966 and assigned to the same assignee as the present application.

Because weight and space are at a premium, particularly in aircraft, synchros are being made so small that the rotor shaft is not of sufficient diameter to provide space in the hollow interior for a pin on which to wind the coiled leads from the rotor windings.

SUMMARY OF THE INVENTION

The present invention overcomes this space problem by forming each lead into a coil with a straight portion extending therefrom. The leads are disposed oppositely in the interior of the hollow shaft with the coil of each of one lead encircling the straight portion of the other lead. The straight portions are positioned axially in the rotor shaft. With this arrangement the straight portion of each lead acts as a mandrel for the coil of the other lead so that the coils wind and unwind smoothly with minimum strain on the wires. Tests were conducted and the wires showed no degradation after approximately 4,000,000 cylces through an angle of 360° rotation.

The invention contemplates electrical apparatus comprising a rotor and a stator, the rotor having a winding thereon, a shaft supporting said rotor for rotation relative to said stator and having a hollow interior portion, leads connected to the rotor winding for connecting the winding to non-rotating circuitry, each of the leads having a straight portion and a coil portion and the leads being disposed in the hollow interior portion of the shaft with the coil of one of the leads being arranged around the straight portion of the other lead and the coil of the other lead being arranged around the straight portion of the first lead.

DRAWING

DETAILED DESCRIPTION OF THE INVENTION

Figure 1:
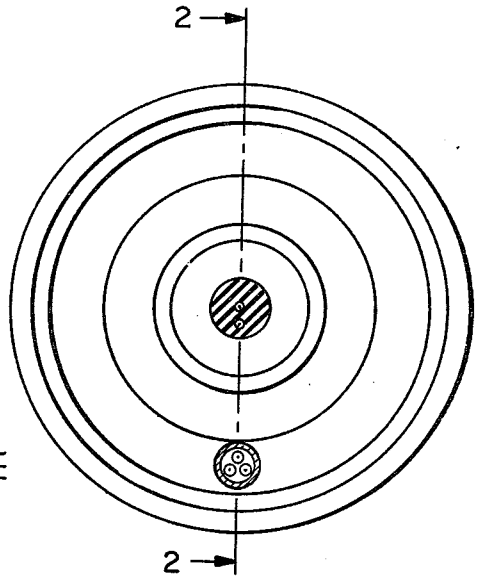
FIG. 1 is an end view of a synchro constructed according to invention.
Figure 2:
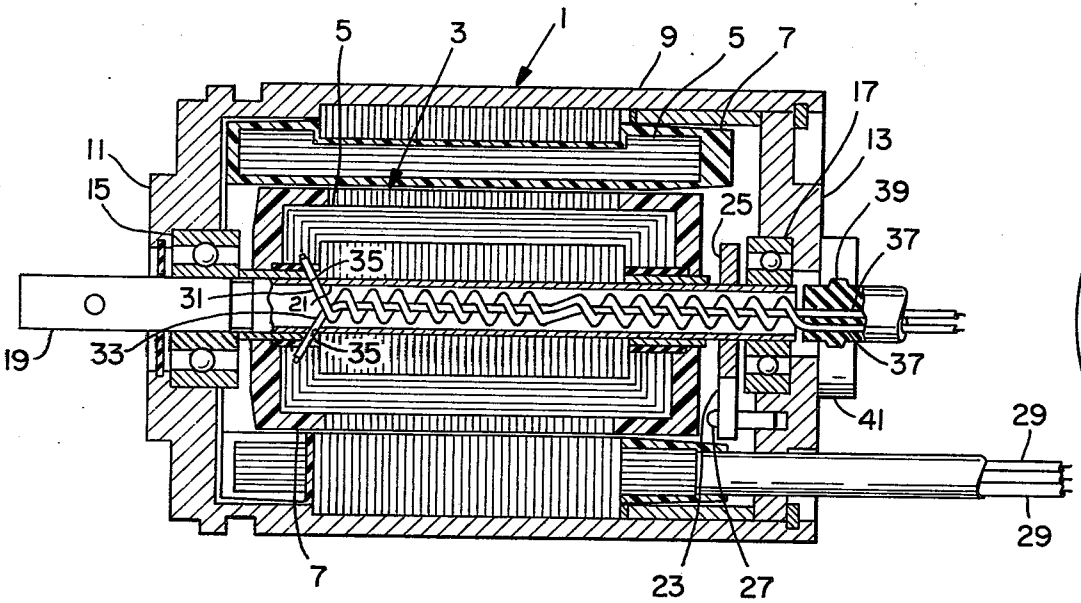
FIG. 2 is an axial section taken approximately on the line 2—2 of FIG. 1.

Referring to the drawing the novel synchro shown therein comprises a stator assembly 1 and a rotor assembly 3 each having windings 5 encapsulated in an electric insulating compound 7. A hollow casing 9 has end walls 11 and 13 with bearing assemblies 15 and 17, respectively, which receive a shaft 19 supporting the rotor for rotation relative to the stator. Shaft 19 has a hollow interior 21 within rotor windings 5 for the purpose described hereinafter.

Rotation of rotor assembly 3 relative to stator assembly 1 is limited to an angle of approximately 360° by an arm 23 extending radially from a ring 25 keyed to rotor shaft 19. Arm 23 engages opposite sides of a pin 27 pressed into end wall 13.

Stator windings 5 may be connected to an alternating current power source by conductors 29 in the usual manner. Novel means are provided for connecting rotor windings 5 to external non-rotating circuitry. Rotor windings 5 are connected to one end of leads 31 and 33 by soldering or other suitable connection and the ends of the leads are embedded in insulating compound 7. The insulated conductors pass through openings 35 in shaft 19 into hollow interior 21 to effectively secure the leads to rotor assembly 3 to rotate therewith.

Within the hollow interior of shaft 19 leads 31 and 33 are each formed into a coil with a straight portion extending therefrom and the leads are disposed oppositely in the interior of the hollow shaft. The coil on lead 31 is wound loosely around the straight portion of lead 33 and the coil on lead 33 is wound loosely around the straight portion of lead 31. The straight portions of leads 31 and 33 preferably extend axially in the hollow interior of shaft 19.

Leads 31 and 33 individually pass through openings 37 in a grommet 39, which may be of teflon or other suitable material, clamped to end wall 13 by a clamp 41 to prevent the leads from rotating. Grommet 39 and leads 31 and 33 extend through end wall 13 for connection to exterior circuitry.

The leads preferably are made of teflon coated stranded wires and the straight portion of one lead acts as a mandrel for the coil of the other lead so that the coils wind and unwind smoothly with minimum strain on the wires.

In some instances it may be desirable to make the coiled portions of leads 31 and 33 of spring material so that they function as a torsion spring to move the rotor to null or zero position with arm 23 in engagement with or in predetermined spaced relation to pin 27 to eliminate hysteresis.

A device of the kind described constructed according to the invention avoids the use of slip rings when the rotor has limited angular movement. The invention is especially adapted for use in synchros of small size where the space in the hollow interior of the rotor shaft does not permit the use of a pin positioned axially within the coils as is in the above patent.

What is claimed is:

1. Electrical apparatus comprising a rotor and a stator, the rotor having a winding thereon, a shaft supporting said rotor for rotation relative to said stator and having a hollow interior portion, leads connected to the rotor winding for connecting the winding to non-rotating circuitry, each of the leads having a straight portion and a coil portion and the leads being disposed in the hollow interior portion of the shaft with the coil of one lead being arranged around the straight portion of the other lead and the coil of the other lead being arranged around the straight portion of the first lead.

2. Electrical apparatus as described in claim 1 having means for securing the straight portion of one lead and the associated coil of the other lead to the rotor for rotation therewith and for securing the straight portion of said other lead and the associated coil of said one lead to the stator to prevent their rotation.

3. Electrical apparatus as described in claim 1 in which the leads are disposed oppositely in the hollow interior of the shaft.

4. Electrical apparatus as described in claim 3 in which the straight portions of the leads are positioned substantially axially of the shaft.

5. Electrical apparatus as described in claim 4 in which the coils are wound loosely on the associated straight portions.

6. Electrical apparatus as described in claim 5 having means for limiting relative rotation of the rotor and stator to approximately 360°.

7. Electrical apparatus as described in claim 1 in which the hollow interior portion of the shaft is within the rotor windings.

* * * * *